US012674625B2

(12) United States Patent
Viinikkala

(10) Patent No.: US 12,674,625 B2
(45) Date of Patent: Jul. 7, 2026

(54) PLATE HEAT EXHANGER ARRANGEMENT, USE OF IT IN EXHAUST GAS HEAT RECOVERY AND METHOD FOR RECOVERING HEAT FROM EXHAUST GAS

(71) Applicant: Vahterus Oy, Kalanti (FI)

(72) Inventor: Reima Viinikkala, Lokalahti (FI)

(73) Assignee: VAHTERUS OY, Kalanti (FI)

( * ) Notice: Subject to any disclaimer, the term of this patent is extended or adjusted under 35 U.S.C. 154(b) by 96 days.

(21) Appl. No.: 18/718,372

(22) PCT Filed: Dec. 19, 2022

(86) PCT No.: PCT/FI2022/050846
§ 371 (c)(1),
(2) Date: Jun. 10, 2024

(87) PCT Pub. No.: WO2023/118653
PCT Pub. Date: Jun. 29, 2023

(65) Prior Publication Data

US 2025/0052506 A1 Feb. 13, 2025

(30) Foreign Application Priority Data

Dec. 21, 2021 (FI) ..... 20216308

(51) Int. Cl.
*F28F 9/00* (2006.01)
*F28D 9/00* (2006.01)
*F28D 21/00* (2006.01)

(52) U.S. Cl.
CPC ..... *F28D 9/005* (2013.01); *F28D 9/0037* (2013.01); *F28D 21/0003* (2013.01); *F28F 9/001* (2013.01)

(58) Field of Classification Search
CPC ..... F28F 9/001; F28D 21/0003
See application file for complete search history.

(56) References Cited

U.S. PATENT DOCUMENTS 5,383,516 A * 1/1995 Dinulescu ..... F28D 9/0062 165/82
10,393,404 B2 * 8/2019 Kondo ..... F24H 9/1832
2008/0233043 A1 * 9/2008 Olbert ..... B01J 8/0453 570/248

(Continued)

FOREIGN PATENT DOCUMENTS

EP 3627085 B1 10/2021
WO 2017093603 A1 6/2017

OTHER PUBLICATIONS

International Search Report and Written Opinion of the ISA for PCT/FI2022/050846, mailed Feb. 15, 2023, 12 pages.

(Continued)

*Primary Examiner* — Devon Lane
(74) *Attorney, Agent, or Firm* — Nixon & Vanderhye

(57) ABSTRACT

A plate heat exchanger arrangement (1), which comprises a flow channel structure (2*a*, 2*b*) having an inlet connection (3) and an outlet connection (4) for a medium flowing in the flow channel, and at least one plate pack module (5) and a frame structure (6) to which the plate pack module is removably arranged and which frame structure (6) is arranged as a part of the flow channel structure. A plate heat exchanger arrangement (1) is used in exhaust gas heat recovery by arranging a plate heat exchanger arrangement as a part of the exhaust gas channel.

11 Claims, 3 Drawing Sheets

(56) References Cited

U.S. PATENT DOCUMENTS

| | | | | |
|---|---|---|---|---|
| 2015/0068501 | A1* | 3/2015 | Ferlay | F02B 29/0475 123/542 |
| 2015/0168085 | A1* | 6/2015 | Wagner | F28F 13/18 165/133 |
| 2017/0023315 | A1* | 1/2017 | Devedeux | F02B 29/0462 |
| 2019/0186324 | A1* | 6/2019 | Greber | F01N 13/1838 |
| 2020/0132397 | A1* | 4/2020 | Nishimura | F28F 9/0282 |
| 2025/0052506 | A1* | 2/2025 | Viinikkala | F28D 21/0003 |

OTHER PUBLICATIONS

Finnish Search Report for FI20216308 dated Jun. 14, 2022, 1 page.

* cited by examiner

PLATE HEAT EXHANGER ARRANGEMENT, USE OF IT IN EXHAUST GAS HEAT RECOVERY AND METHOD FOR RECOVERING HEAT FROM EXHAUST GAS

CROSS-REFERENCE TO RELATED APPLICATIONS

This application is the U.S. national phase of International Application No. PCT/FI2022/050846 filed Dec. 19, 2022, which designated the U.S. and claims priority to FI 20216308 filed Dec. 21, 2021, the entire contents of each of which are hereby incorporated by reference.

FIELD OF THE INVENTION

The present invention relates to a plate heat exchanger arrangement according to the independent claim presented below. The invention relates also to use of a plate heat exchanger arrangement in exhaust gas heat recovery and a method for recovering heat from exhaust gas.

BACKGROUND OF THE INVENTION

Extracting heat that would normally be lost when releasing the exhaust gases, improves significantly the overall thermal efficiency of the associated system. Heat can be recovered and used for a variety of heating or cooling requirements, or generating steam, or generating electricity, e.g. via an ORC system. Once recovered, the heat energy can be utilized for a range of uses, which contribute to reducing energy costs.

Exhaust gas heat exchangers are an efficient way of recovering the waste heat from exhaust gases generated during energy generation. Exhaust gas heat exchangers can be used wherever waste heat is generated by exhaust gases. For example, tube heat exchangers are commonly used, but they are typically heavy and large sizes, and so they are not applicable in all applications. The maintenance and the cleaning of the tube heat exchanger is typically also laborious.

Therefore, there exists a need for heat exchangers in the field of the exhaust gas heat recovery, which have a compact structure and are easy to clean and service.

SUMMARY OF THE INVENTION

The present invention provides a plate-type heat exchanger especially for exhaust gas heat recovery that overcomes the afore-mentioned problems.

The present invention provides a plate heat exchanger arrangement which has compact structure, and which provide easy maintainability and cleaning of the plate pack.

The present invention also provides a plate heat exchanger arrangement, which is easy to modify and scale to the different applications depending on to which purpose the recovered heat is planned to be used. The present invention also provides an embodiment where several separate heat recovery circulations can be arranged to the same arrangement and thus easy arranging of them to the exhaust gas channel.

In order to achieve among others the objects presented above, the invention is characterized by what is presented in the enclosed claims.

The embodiments and advantages mentioned in this text relate, where applicable, both to the plate heat exchanger arrangement, the method as well as to the uses according to the invention, even though it is not always specifically mentioned.

Typical plate heat exchanger arrangement according to the present invention comprises a flow channel structure formed of the walls of the flow channel and having an inlet connection and an outlet connection for a medium flowing in the flow channel, and at least one plate pack module and its frame structure to which the plate pack module is removably arranged and which frame structure is arranged as a part of the flow channel structure. A typical frame structure comprises a framework formed of the upright support beams in the corners of the frame structure and the horizontal support beams connecting the upright support beams, wherein the side surfaces of the framework arranged against the flow channel are open, and the walls of the flow channel structure have been attached to the frame structure. A typical plate pack module of the plate heat exchanger arrangement according to the present invention comprises

- a plate pack formed of elongated rectangular heat exchanger plates having openings and arranged on top of each other, whereby the plate pack has a height direction, and in which plate pack the heat exchange plates are attached to each other as plate pairs, the inner parts of which plate pairs are arranged in connection with each other via flow channels formed by the opening of the heat exchange plates,
- an inlet connection and an outlet connection for a heat transfer fluid, which connections are arranged in connection with the flow channels and the inner parts of the plate pairs of the plate pack,
- the support end plates arranged on both ends of the plate pack, and
- the side support plates arranged on both side end surfaces of the plate pack, whereby the side support plates substantially cover the side end surfaces of the plate pack in the height direction of the plate pack, and the plate pack module is arranged to the flow channel structure in such a manner that the height direction of the plate pack formed of the elongated rectangular heat exchange plates is in perpendicular to the flow direction of the medium flowing in the flow channel, whereby the width direction of the heat exchange plates is in a flow direction of the medium flowing in the flow channel.

Typically, a plate heat exchanger arrangement according to the present invention is used in exhaust gas heat recovery. A plate heat exchanger arrangement according to the present invention is applicable to be used whichever system where waste heat is generated. In an embodiment according to the present invention, a plate heat exchanger arrangement according to the present invention is used in exhaust gas heat recovery in power plants or other plants having exhaust gas heat. The compact structure and the possibility to arrange multiple separate heat recovery circulations to the same arrangement are especially useful in ships and vessels. Therefore, in an advantageous embodiment, a plate heat exchanger arrangement according to the present invention is used in exhaust gas heat recovery in ships or vessels.

In a typical method according to the present invention for recovering heat from exhaust gas, heat is recovered by arranging a plate heat exchanger arrangement according to the present invention as a part of the exhaust gas channel, whereby an exhaust gas is guided to flow through flow channel structure and the plate pack of the plate pack module.

A plate heat exchanger arrangement according to the present invention provides compact design due to the elongated rectangular heat exchange plates used in the plate pack. The plate pack module which is removably arranged to the frame structure provides easy inspection, cleaning, and maintainability of the plate pack. A plate pack module of the plate heat exchanger arrangement according to the present invention itself is made to pressure-tight self-supporting structure, which makes possible easily to modify and scale a plate heat exchanger arrangement of the present invention to the different applications depending on to which purpose the recovered heat is planned to be used. Using the plate heat exchanger arrangement according to the present invention, it is possible to easy arrange two or more plate pack modules with their frame structures into the flow channel structure.

A plate heat exchanger arrangement of the present invention provides an efficient utilization of exhaust gas waste heat. By using the present invention heat can be recovered and used for a variety of heating and/or cooling requirements or generating steam, or e.g. generating more electricity, via an ORC system.

DESCRIPTION OF THE DRAWINGS

The invention is described in more detail below with reference to the enclosed schematic drawing, in which.

DETAILED DESCRIPTION OF THE INVENTION

Figure 1:
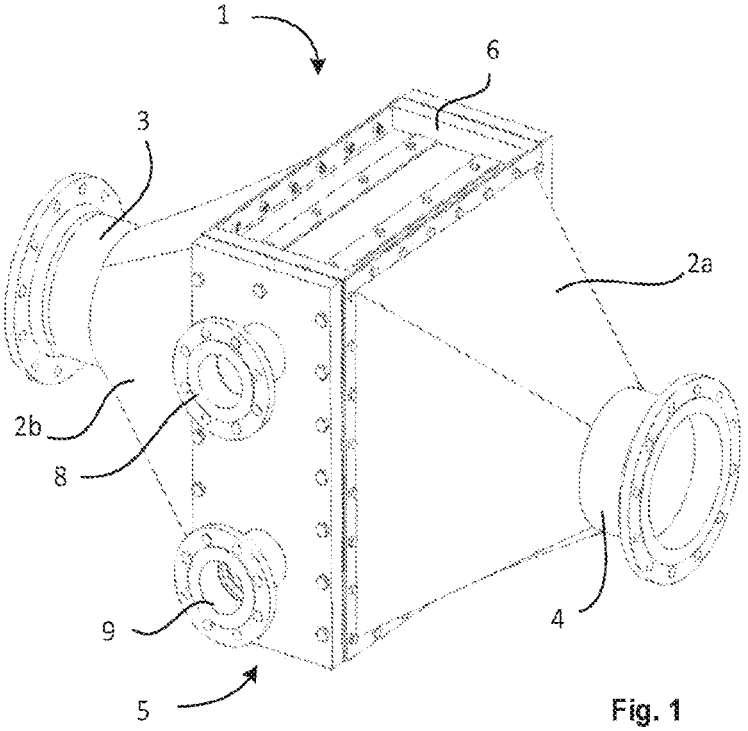
FIG. 1 shows a plate heat exchanger arrangement according to an embodiment of the invention.

A plate heat exchanger arrangement according to the present invention comprises a flow channel structure and at least one plate pack module and a frame structure to which the plate pack module is removably arranged, and which frame structure is arranged as a part of the flow channel structure.

A flow channel structure of the plate heat exchanger arrangement according to the present invention is formed of the walls of channels and it comprises an inlet connection and an outlet connection for a medium flowing in the flow channel. A flow channel structure is typically a duct. In a preferred embodiment of the present invention, a flow channel structure is an exhaust gas channel, whereby the flow channel structure comprises inlet and outlet connections for exhaust gas stream. According to an embodiment of the present invention, inlet and outlet connections of the flow channel structure of the present arrangement is used for connecting the plate heat exchanger arrangement of the present invention to an exhaust gas duct for supplying a hot exhaust gas into the arrangement and for connecting the plate heat exchanger arrangement of the present invention to an exhaust gas duct for conveying the cooled exhaust gas out flow from the heat exchanger arrangement. In an embodiment according to the present invention, a flow channel structure may be an exhaust gas duct or other duct to which the plate heat exchanger arrangement has been arranged and so it is a part of the flow channel structure of the exhaust gas duct. In this case inlet and out connections of the flow channel structure refer to inlet and outlet of the exhaust gas channel or other channel.

In the present disclosure, the exhaust gas refers to the gas generated as a result of the burning of fuel or other materials. Exhaust gases leave a system after energy exchange or conversion process, e.g. combustion gases from a diesel engine, a boiler, a gas turbine, an incinerator or other corresponding system in power plant or other plant. The exhaust gas can also be called as flue gas. The exhaust gases are conveyed out from the combustion system via ducts and the exhaust gas heat can be recovered by arranging a plate heat exchanger arrangement according to the present invention to the duct of the exhaust gas.

A plate pack module according to the present invention comprises a plate pack, which is based on the plate pack structure used in Plate and Shell-type heat exchangers. A plate pack has been formed by arranging heat exchanger plates having openings on top of each other. The heat exchange plates are attached to each other as plate pairs. Each plate pair is typically formed of two heat exchange plates that are attached, preferably welded together at least at their outer periphery. Each heat exchange plate has at least two openings for the flow of a heat transfer fluid. Adjacent plate pairs are attached to each other by attaching, preferably welding the openings of two adjacent plate pairs to each other. The inner parts of the plate pairs are arranged in connection with each other via flow channels formed by the opening of the heat exchange plates. Thus, a heat transfer fluid can flow from a plate pair to another via the openings. An inlet connection and an outlet connection for a heat transfer fluid for leading a heat transfer fluid into the plate pack and out from it are arranged at an end plate of the plate pack. The inlet connection and outlet connection for the heat transfer fluid are arranged in connection with the inner parts of the plate pack, i.e. inner parts of the plate pairs of the plate pack, whereby the circuit is formed between the inlet and outlet connection of the heat transfer fluid. A medium flowing in the flow channel, preferably in the exhaust gas channel, of the plate heat exchanger arrangement according to the present invention is arranged to flow in the spaces between the plate pairs. The inlet and outlet connections for the medium flowing in the flow channel, e.g. for the exhaust gas are arranged in connection with flow channel structure and in connection with the spaces between the plate pairs in the plate pack. In other words, the medium flowing in the flow channel, e.g. the exhaust gas, flows inside the flow channel structure and also flows through the spaces between the plate pairs of the plate pack. The heat transfer fluid flowing in the inner part of the plate pack cannot get mixed with the medium flowing in the flow channel structure. The heat transfer fluid flows in every other plate space and the exhaust gas flows in every other plate space of the plate pack. A heat transfer fluid can be a gas or liquid that takes part in heat transfer.

A plate pack of the plate pack module is formed of the elongated rectangular heat exchange plates. In a preferred embodiment of the present invention, a plate pack of the plate pack module is formed of the elongated rectangular heat exchange plates having curved ends. In other words, plate pack according to an embodiment of the present invention is formed of heat exchange plates having an elongated shape formed of two half ellipses. The curved ends of the heat exchange plates improve the pressure proof of the plate pack, and also the welding of the plate pack is easier. The heat exchange plates have a length direction and a width direction. The length direction of the rectangular heat exchange plate refers to the direction of the longest side of the plate. Correspondingly the length direction refers to the direction of the plate from one curved end to another curved end. The width direction of the heat exchange plate is a direction in perpendicular to the length direction. The width direction is typically shorter than the length direction, since the heat exchange plates are elongated rectangular plates, i.e. the plate pack is formed of slim heat exchange plates. The openings of the heat exchange plate have been arranged on both ends of the elongate plate heat exchange plate, which openings forms flow channels to a heat transfer fluid flowing inside the plate pairs.

As disclosed above, the plate pack has been formed by arranging plate pairs of the plate heat exchange plates on top of each other. In the present disclosure, a height direction of the plate pack refers to a direction of the plate pack formed of the plate pairs on top of each other, i.e. a height of the stack of the plate pairs. A plate pack has same length direction and width direction as the heat exchange plates. The plate pack has large side surfaces defined by the height direction and the length direction of the plate pack, and thinner side end surfaces formed of the ends, preferably curved ends of the heat exchange plates and defined by the height direction and the width direction of the plate pack. The side end surfaces are substantially perpendicular to the large side surfaces.

In the plate pack module, the support end plates have been arranged on both ends of the plate pack in the height direction of the plate pack. The support end plates have a substantially same outer shape as the heat exchange plates, but they are typically thicker than the heat exchange plates.

The plate pack module also comprises side support plates arranged on both side end surfaces of the plate pack, whereby the side support plates substantially cover the side end surfaces of the plate pack in the height direction of the plate pack. The side end surfaces of the plate pack refer to the side ends of the plate pack formed of the ends of the heat exchange plates, typically formed of the curved ends of the heat exchange plates. In an embodiment of the present invention, the side support plates of the plate pack extend from the one support end plate to the other support end plate of the plate pack, whereby the side support plates substantially cover the side end surfaces of the plate pack in the height direction of the plate pack. The side support plates may be formed as one uniform part, or they may be formed of two or more parts. The side support plates make the structure of the plate pack module stronger, and they also may function as a flow guide by preventing by-pass flow of the exhaust gas in the flow channel structure. According to an embodiment of the present invention, the side support end plates have been bent at least partly to the large side surfaces of the plate pack. Consequently, the gas flow can be guided efficiently through the plate pack in the central part of the flow channel.

Further, the plate pack module comprises inlet and outlet connections for a heat transfer fluid, which connections are arranged in connection with the flow channels and the inner parts of the plate pairs of the plate pack.

In a preferred embodiment of the present invention the plate pack module is completely welded. The plate pack module itself is the pressure-tight self-supporting structure.

In an embodiment of the present invention the plate pack may comprise an inner tube structure and a stopper plate or plates arranged into the flow channels of the plate pack. These make possible to arrange multiple passes to the plate pack.

A plate heat exchanger arrangement further comprises a frame structure to which plate pack module is removably arranged. The frame structure according to the present invention is a framework which set around the plate pack module. It comprises support beams in all sides of the plate pack module, typically in the corners of the plate pack module. According to the present invention the frame structure comprises a framework formed of the upright support beams in the corners of the frame structure and the horizontal support beams connecting the upright support beams. When plate pack module has been arranged to the frame structure, the support beams circulate the corners of the plate pack module. The side surfaces of the framework arranged against the flow channel are open for allowing exhaust gas flowing through the plate pack module. The frame structure comprises a cover plate for closing the side surface of the frame structure, which is opposite to the side surface from which the plate pack module is arrangeable to the frame structure.

According to an embodiment of the present invention, the frame structure may further comprise additional flow guide plates arranged at the frame structure. The flow guide plates may be arranged at the corners of the frame structure for guiding the flow of the exhaust gas to flow through the plate pack in the central part of the flow channel.

According to a typical embodiment of the present invention plate pack module further comprises the end plate at one end of the plate pack, by which end plate the plate pack module is detachably fixed to a flange of the frame structure. The end plate has been attached to the support end plate of the plate pack. Hence, the plate pack module can be easily detached from the plate heat exchanger arrangement and pulled out from the frame structure e.g. for inspection, cleaning or other maintenance.

In the plate heat exchanger arrangement according to an embodiment of the present invention, the frame structure of the plate pack module and the flow channel structure attached to the frame structure form a framework of the plate heat exchanger arrangement of the present invention. According to the present invention the frame structure is arranged as a part of the flow channel structure. In a typical embodiment of the present invention, the channel structure of the plate heat exchanger arrangement has been attached to the frame structure of the plate pack module. According to an embodiment of the present invention, the walls of the flow channel structure have been attached to the frame structure. Hence, the frame structure of the plate pack module forms a part of the channel structure.

In a typical embodiment according to the invention, the plate pack module is arranged to the flow channel structure in such a manner that the width direction of the heat exchange plates is in a flow direction of the medium flowing in the flow channel, such as in a flow direction of exhaust gas. In other words, the plate pack module is arranged to the flow channel structure in such a manner that the height direction of the plate pack formed of the elongated rectangular heat exchange plates is in perpendicular to the flow direction of the medium flowing in the flow channel, such as exhaust gas, and the medium flowing in the flow channel flows through the plate pack in width direction of the plate pack. Hence, the length of the flow travel of the exhaust gas through the plate pack is arranged to be short. This is advantageous since the exhaust gas is a product of combustion and contains particulate and other undesirable matter, and hence exhaust gas may cause particulate build-up into the plate pack and so weaken heat transfer. This can be avoided by the plate pack module according to the present invention. Further, the pressure loss of the gas is low when it flows through the plate pack formed of the elongates rectangular heat exchange plates so that the length of the flow travel of the exhaust gas through the plate pack is arranged to be short. Correspondingly, the flow direction of a heat transfer fluid inside the plate pack can be arranged longer, since they flow in the length direction of the plates through the plate pack and hence the heat transfer is efficient in the whole plate pack.

According to the present invention, the plate heat exchanger arrangement comprises at least one plate pack module and its frame structure arranged as a part of the flow channel structure. Hence, in one embodiment of the present invention the plate heat exchanger arrangement comprises one plate pack module and its frame structure arranged as a part of the flow channel structure. In other embodiments according to the present invention, the plate heat exchanger arrangement comprises two or more plate pack modules with their frame structures, which have been arranged into the flow channel. In a preferred embodiment according to the present invention, each plate pack module comprises own frame structure. Hence, the structure is easy to scale and modify depending on the required function. The frame structures can be attached to each other.

Two or more plate pack modules with their frame structures can be arranged to the plate heat exchanger structure in many ways. In an embodiment, two or more plate pack modules with their frame structures have been arranged side by side in the flow direction of medium into the flow channel. In another embodiment, two plate pack modules with their frame structures have been arranged one on top of the other into the flow channel. The flow channel may comprise plate pack modules side by side in the flow direction of medium into the flow channel and/or one on top of the other into the flow channel.

According to the preferred embodiment of the present invention, the plate pack modules are arranged to the flow channel structure in such a manner that the height direction of the plate packs formed of the elongated rectangular heat exchange plates are in perpendicular to the flow direction of the medium flowing in the flow channel, such as exhaust gas, and the medium flowing in the flow channel flows through the plate packs in width direction of the plate packs.

In an embodiment two plate pack modules with their frame structures are arranged end to end against each other, whereby the inlet and outlet connections of the plate pack modules are in different sides of the flow channel structure. Also, in this embodiment the flow channel may comprise plate pack modules side by side in the flow direction of medium into the flow channel and/or one on top of the other into the flow channel.

A plate heat exchanger arrangement according to the present invention is applicable to be used whichever system where waste heat is generated, typically by exhaust gases. As described above the arrangement according to the present invention may comprise one, two or several plate pack modules with their frame structures, which are arranged to the flow channel.

In a method according to the present invention for recovering heat from exhaust gas, heat is recovered by arranging a plate heat exchanger arrangement according to the present invention as a part of the exhaust gas channel, whereby an exhaust gas is guided to flow through the plate pack of the plate pack module.

DETAILED DESCRIPTION OF THE DRAWINGS

Figure 2:
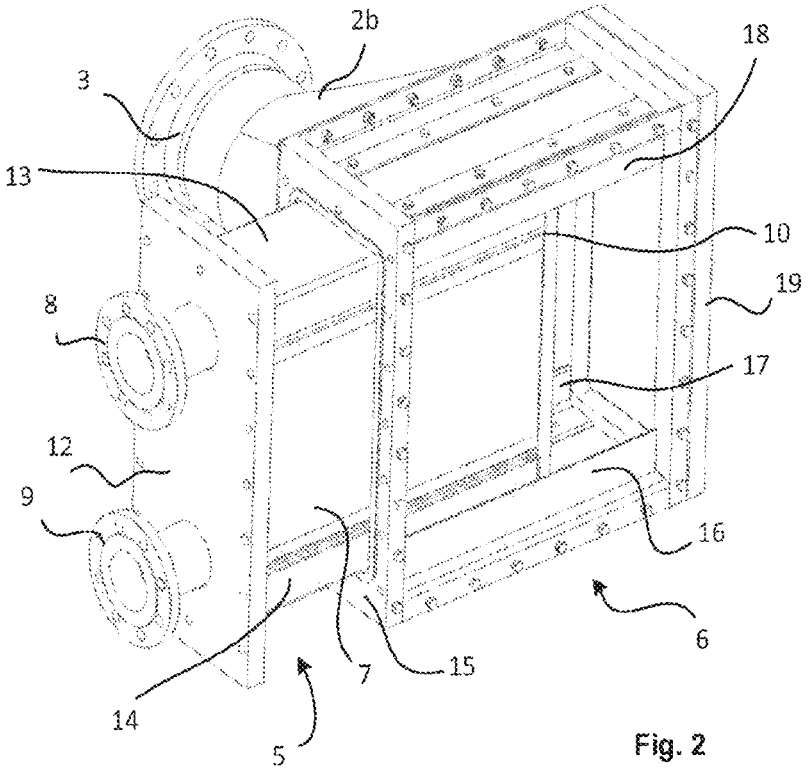
FIG. 2 shows more detailed the plate pack module of the plate heat exchanger arrangement according to an embodiment of the invention.
Figure 3:
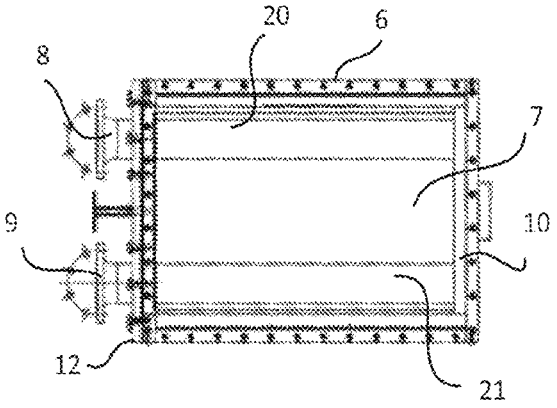
FIG. 3 shows a schematic cross-section of the plate pack module according to an embodiment of the invention arranged at its frame structure.
Figure 4:
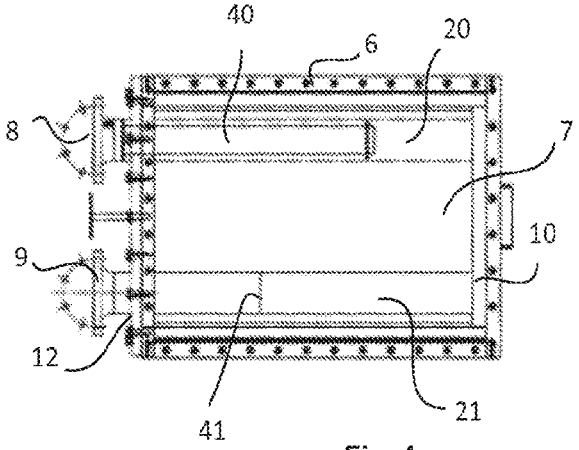
FIG. 4 shows a schematic cross-section of the plate pack module according to another embodiment of the invention arranged at its frame structure.

FIG. 1 shows a plate heat exchanger arrangement according to an embodiment of the invention and FIG. 2 shows more detailed the plate pack module of the plate heat exchanger arrangement showed in FIG. 1. FIGS. 3 and 4 show a schematic cross-section of the plate pack modules according to some embodiment of the invention arranged at its frame structure.

A plate heat exchanger arrangement 1 according to an embodiment of the present invention comprises a flow channel structure having an inlet connection 3 and an outlet connection 4 for a medium flowing in the flow channel. In FIG. 1, the flow channel structure is formed of two parts 2*a*, 2*b* attached to a frame structure 6. A plate heat exchanger arrangement 1 presented in FIG. 1 comprises one plate pack module 5 and a frame structure 6 to which the plate pack module 5 is removably arranged. The frame structure 6 has been arranged as a part of the flow channel structure.

A plate pack module 5 according to the present invention showed detailed in FIG. 2 comprises a plate pack 7 formed of elongated rectangular heat exchanger plates having openings and arranged on top of each other. In the plate pack 7 according to the present invention the heat exchange plates are attached to each other as plate pairs, the inner parts of which plate pairs are arranged in connection with each other via flow channels 20, 21 formed by the opening of the heat exchange plates as shown in FIGS. 3 and 4. The plate pack module 5 comprises inlet connection 8 and outlet connection 9 for a heat transfer fluid, which connections are arranged in connection with the flow channels 20, 21 and the inner parts of the plate pairs of the plate pack.

Further, a plate pack module 5 comprises the support end plates 10 arranged on both ends of the plate pack 7. Typically, the plate pack module 5 further comprises the end plate 12 at one end of the plate pack, by which end plate the plate pack module is detachably fixed to a flange 15 of the frame structure. Only one support end plate, i.e. the support end plate 10, is visible in FIGS. 2-4. The other support end plate of the plate pack has been arranged between the plate pack 7 and the end plate 12. The support end plate and the end plate 12 are typically attached to each other, but it may also be possible to made them as one piece.

Further, a plate pack module 5 comprises the side support plates 13, 14 arranged on both side end surfaces of the plate pack 7, whereby the side support plates 13, 14 substantially cover the side end surfaces of the plate pack in the height direction of the plate pack. A height direction of the plate pack refers to a direction of the plate pack formed of the plate pairs on top of each other, i.e. a height of the stack of the plate pairs. Typically, the side support plates 13, 14 of the plate pack extend from the one support end plate 10 to the other support end plate of the plate pack.

In FIG. 2, the side support plates 13, 14 have been bent at least partly to the large side surfaces of the plate pack 7. The large side surfaces of the plate pack are defined by the height direction and the length direction of the plate pack, and these large surfaces are against the flow channel, i.e. the height direction of the plate pack formed of the elongated rectangular heat exchange plates is in perpendicular to the flow direction of the medium flowing in the flow channel, such as exhaust gas. This means that the plate pack module 5 is arranged to the flow channel structure in such a manner that the width direction of the heat exchange plates is in a flow direction of the medium flowing in the flow channel, such as exhaust gas.

A frame structure 6 of the plate heat exchanger arrangement 1 according to the present invention comprises a framework formed of the upright support beams in the corners of the frame structure and the horizontal support beams connecting the upright support beams as can be seen from FIG. 2. The frame structure 6 is a framework which set around the plate pack module 5. The frame structure 6 may further comprise one or more flow guide plates 16, 17, 18 arranged at the frame structure. Typically, flow guide plates 16, 17, 18 have been arranged at the lower part and/or upper part of the frame structure 6 in the height direction of the flow channel.

As shown in FIG. 2, the side surfaces of the framework arranged against the flow channel are open for allowing exhaust gas flowing through the plate pack module. Typically, the frame structure 6 comprises a cover plate 19 for closing the side surface of the frame structure, which is opposite to the side surface from which the plate pack module 5 is arrangeable to the frame structure.

As shown in FIGS. 1 and 2, a frame structure is a part of the flow channel structure. The walls of the flow channel structure 2*a*, 2*b* have been attached to the frame structure 6.

FIGS. 3 and 4 present some embodiments to arranged flow inside the plate pack 7. FIG. 4 shown inner tube structure 40 arranged in the flow channel 20 and a stopper plate 41 arranged in the flow channel 21 for providing multiple passes for a heat transfer fluid flow inside the plate pack.

Figure 5:
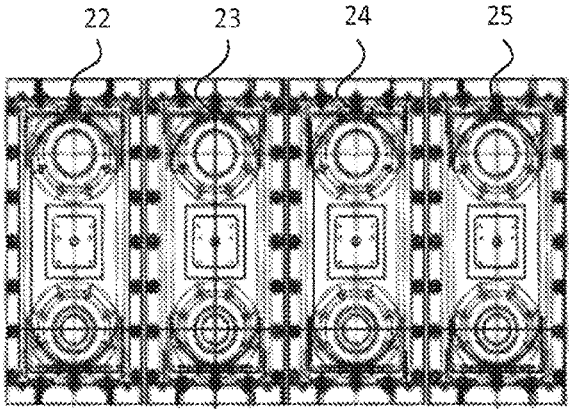
FIG. 5 shows an embodiment according to the present invention, where four plate pack modules with their frame structures have been arranged side by side in the flow direction of medium to the flow channel.
Figure 6:
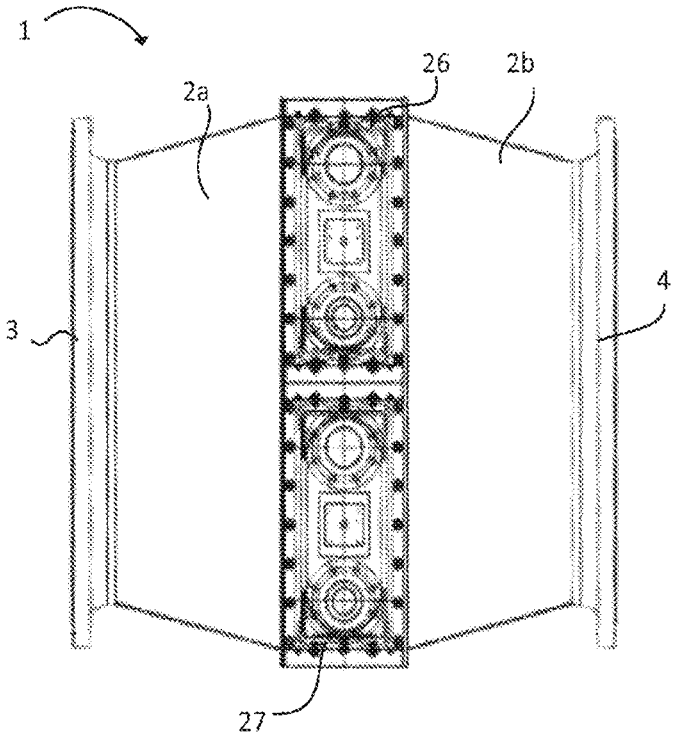
FIG. 6 shows an embodiment according to the present invention, where two plate pack modules with their frame structures have been arranged one on top of the other into the flow channel structure.
Figure 7:
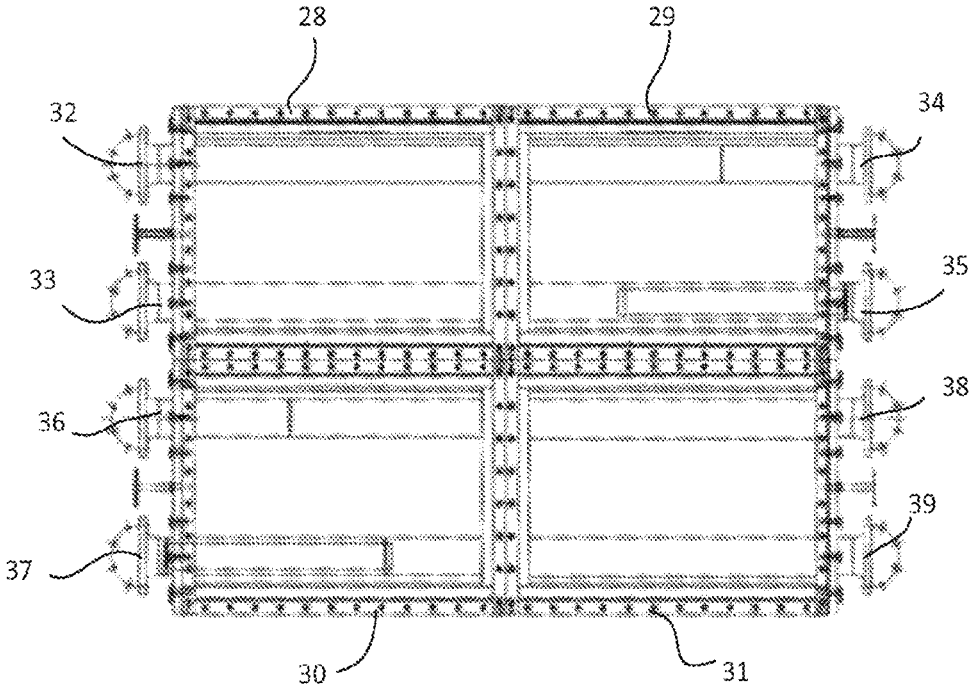
FIG. 7 shows a schematic cross-section of an embodiment according to the present invention, where two plate pack modules with their frame structures are arranged end to end against each other, whereby the inlet and outlet connections of the plate pack modules are in different sides of the flow channel structure.

FIGS. 5-7 show some embodiments according to the present invention, where the plate heat exchange arrangement comprises two or more plate pack modules.

FIG. 5 shows an embodiment according to the present invention, where four plate pack modules 22, 23, 24, 25 with their frame structures have been arranged side by side. They can be arranged to the flow channel structure so that they are side by side in the flow direction of medium in the flow channel. Further, the plate pack modules are arranged to the flow channel structure in such a manner that the height direction of the plate packs formed of the elongated rectangular heat exchange plates are in perpendicular to the flow direction of the medium flowing in the flow channel, such as exhaust gas.

FIG. 6 shows a plate heat exchanger arrangement 1 according to an embodiment of the present invention, where two plate pack modules 26, 27 with their frame structures have been arranged one on top of the other into the flow channel structure. The flow channel structures 2*a*, 2*b* have been attached to the frame structures of the plate pack modules. The height direction of the plate packs of the plate pack modules is perpendicular to the flow direction of medium to the flow channel. The plate heat exchanger arrangement 1 further comprises an inlet connection 3 and an outlet connection 4 for a medium flowing in the flow channel.

FIG. 7 shows an embodiment according to the present invention, where two plate pack modules 28, 29 with their frame structures have been arranged end to end against each other, whereby the inlet connections 33, 35 and outlet connections 32, 34 of the plate pack modules have been arranged in different sides of the flow channel structure. In FIG. 7, other two plate pack modules 30, 31 with their frame structures have been arranged under the plate pack modules 28, 29. Also, plate pack modules 30, 31 with their frame structures have been arranged end to end against each other, whereby the inlet connections 37, 39 and outlet connections 36, 38 of the plate pack modules have been arranged in different sides of the flow channel structure. All frame structures have been attached to each other for forming the compact plate heat exchanger arrangement.

The invention claimed is:

1. A plate heat exchanger arrangement comprising:

a flow channel structure formed of walls of a flow channel and having an inlet connection and an outlet connection for a medium flowing in the flow channel;

at least one plate pack module; and a frame structure to which the at least one plate pack module is removably connected, the frame structure being configured as a part of the flow channel structure, the frame structure comprising a framework formed of upright support beams in corners of the frame structure and horizontal support beams connecting the upright support beams, side surfaces of the framework disposed against the flow channel structure being open, the walls of the flow channel structure being attached to the frame structure, wherein the at least one plate pack module comprises a plate pack of elongated rectangular heat exchanger plates having openings and disposed on top of each other, the plate pack having a height direction, the elongated rectangular heat exchanger plates being attached to each other as plate pairs in the plate pack, inner parts of the plate pairs being disposed in connection with each other via additional flow channels defined by the openings of the elongated rectangular heat exchanger plates, an inlet connection and an outlet connection for a heat transfer fluid, the inlet and outlet connections being disposed in connection with the additional flow channels and the inner parts of the plate pairs of the plate pack, support end plates disposed on both ends of the plate pack, side support plates disposed on both side end surfaces of the plate pack, the side support plates substantially covering the side end surfaces of the plate pack in the height direction of the plate pack, and an end plate at one end of the plate pack, the at least one plate pack module being detachably fixed to a flange of the frame structure by the end plate, wherein the at least one plate pack module is disposed in relation to the flow channel structure such that the height direction of the plate pack formed of the elongated rectangular heat exchanger plates is perpendicular to a flow direction of a medium flowing in the flow channel, the width direction of the elongated rectangular heat exchanger plates is in the flow direction of the medium flowing in the flow channel.

2. The arrangement according to claim 1, wherein the elongated rectangular heat exchanger plates have curved ends.

3. The arrangement according to claim 1, wherein the side support plates are bent at least partly to large side surfaces of the plate pack.

4. The arrangement according to claim 1, wherein the side support plates of the plate pack extend from one of the support end plates to another of the support end plates of the plate pack.

5. The arrangement according to claim 1, wherein the at least one plate pack module is welded to form a pressure-tight, self-supporting structure.

6. The arrangement according to claim 1, wherein the frame structure further comprises a flow guide plate.

7. The arrangement according to claim 1, wherein the at least one plate pack module comprises two or more plate pack modules with the respective frame structures disposed side-by-side in a flow direction of medium into the flow channel.

8. The arrangement according to claim 1, wherein the at least one plate pack module comprises two or more plate pack modules with the respective frame structures disposed one on top of the other into the flow channel.

9. The arrangement according to claim 1, wherein the at least two plate pack modules comprise two plate pack modules with the respective frame structures disposed end-to-end against each other, the inlet and outlet connections of a first plate pack module of the two plate pack modules and the inlet and outlet connections of a second plate pack module of the two plate pack modules being in different sides of the flow channel structure.

10. A method comprising:

recovering exhaust gas heat with the plate heat exchanger arrangement according to claim 1.

11. A method for recovering heat from exhaust gas, the method comprising:

recovering the heat by arranging the plate heat exchanger arrangement according to claim 1, as a part of the exhaust gas channel.

* * * * *